United States Patent [19]

Rosson et al.

[11] Patent Number: 4,620,556

[45] Date of Patent: Nov. 4, 1986

[54] LOOSE LEAF CHEWING TOBACCO

[75] Inventors: William M. Rosson, Memphis; William G. Dean, Germantown, both of Tenn.

[73] Assignee: Conwood Corporation, Memphis, Tenn.

[21] Appl. No.: 484,266

[22] Filed: Apr. 12, 1983

[51] Int. Cl.[4] ..... A24B 5/06; A24B 3/07; A24B 5/04

[52] U.S. Cl. ..... 131/313; 131/290; 131/319; 131/322; 131/325; 131/118; 131/366

[58] Field of Search ..... 131/313–325, 131/327, 352, 118, 366, 290

[56] References Cited

U.S. PATENT DOCUMENTS

| | | | |
|---|---|---|---|
| 114,901 | 5/1871 | Alden | 131/366 |
| 137,084 | 3/1873 | Kerr | 131/366 |
| 189,604 | 4/1877 | Cauhape | 131/366 |
| 214,639 | 4/1879 | Emery | 131/366 |
| 421,373 | 1/1890 | Wilson | 131/366 |
| 1,365,969 | 1/1921 | Dula | 131/366 |
| 1,407,274 | 2/1922 | Hibbert | 131/366 |
| 2,176,511 | 10/1939 | Rundell | 131/366 |
| 2,398,450 | 4/1946 | Rundell | 131/320 |
| 3,411,514 | 11/1968 | Hind et al. | 131/366 |
| 3,425,425 | 2/1969 | Hind | 131/366 |
| 4,237,909 | 12/1980 | Jenkins et al. | 131/366 |
| 4,323,083 | 4/1982 | Cogbill | 131/290 |

*Primary Examiner*—V. Millin
*Assistant Examiner*—Beaucage Gregory
*Attorney, Agent, or Firm*—Browdy and Neimark

[57] ABSTRACT

A loose leaf chewing tobacco product is prepared from leaf tobacco by removing the stems and major veins, then cutting the leaves across the grain of the remaining veins in a uniform manner with the cuts being spaced no greater than ¼ inch apart, then casing the leaves with a casing mixture and finally drying the cased leaves.

12 Claims, No Drawings

LOOSE LEAF CHEWING TOBACCO

BACKGROUND OF THE INVENTION

This invention relates to a chewing tobacco product, and more particularly to a product and a method for making the same in which the tobacco is a loose leaf product having small, uniform leaf size with virtually no objectionable stem parts.

Chewing tobacco has been manufactured in various forms for many years, such as pressed plugs, rolled twists, and loose leaf tobacco, formerly called "scrap tobacco". The name "scrap" probably evolved from the origin of the tobacco used in the manufacture of the end product. Originally, some of the tobacco was obtained from other tobacco manufacturing processes such as cigar trimmings. With the advent of homogenized wrapper leaf, cigar trimmings became unsuitable for use in loose leaf chewing tobacco. Therefore, it became necessary to manufacture "scrap" tobacco from virgin air-cured cigar tobacco. Eventually, the term "scrap tobacco" fell into disuse and was replaced by the term "loose leaf" tobacco.

Traditionally, loose leaf tobacco has been made from non-uniform pieces of tobacco, including not only leaf parts, but also stems and veins in various forms.

Essentially two approaches to the production of a commercially acceptable product have been taken: (1) the incorporation of the stem and vein parts into the final product; and (2) the removal of these part from the final product. The latter approach involves primarily mechanical treatment of tobacco leaves, as shown in U.S. Pat. Nos. 2,176,511 to Rundell in which the stems are torn from the leaf web; 2,398,450 to Rundell in which the stem is separated and cut from the leaf blade; and 4,237,909 to Jenkins, Jr. et al, wherein the stems are ripped away from the leaf lamina by rollers. In the former approach, various techniques have been employed to incorporate the stem and vein parts in a tobacco mixture. For example, U.S. Pat. No. 3,411,514 to Hind et al discloses a tobacco product in which stems and veins are passed between rollers to break up or crush the bulky rigid parts. To facilitate an improved, less harsh, more aromatic taste, a slower burn and reduced heat for smoking tobaccos, an aqueous solution of ammonium phosphate is added to the parts either before, during or after rolling thereof. U.S. Pat. No. 3,425,425 to Hind discloses a tobacco product in which stems and veins, first treated with a solution containing a water-soluble carbohydrate, are puffed or expanded, and then mixed or incorporated into a conventional tobacco product, with or without subsequent threshing.

In general, when the prior art refers to stemming (destemming), it concerns primarily the removal of essentially the main stem only. The products, even if cut, consequently retain the major veins which the public often perceives, in a negative way, as being "stems." Indeed, in the prior art processes the tobacco is normally threshed, i.e. passed through a hammer-mill type device having brackets thereon which causes the tobacco leaves to break into pieces which tend to parallel the veins, and thereby leave the veins generally intact.

The inclusion of stem and vein parts in these various forms of smoking-type tobacco products may have been acceptable, if only for economic reasons. However, the use of such parts in chewing tobacco products has often met with adverse reaction. U.S. Pat. No. 421,373 to Wilson discloses the shredding, splitting, cutting, crushing or pulping of stems after softening in water. The patent proposed a method of stem inclusion in which the stems were first ground to a powder and then sprinkled on successive layers of tobacco during packing or casing. During this method, a dampening solution was added to impart flavoring and moisture to the final product. The Wilson process is similar to that of U.S. Pat. No. 1,407,274 to Hibbert in which, in a method of making plug and chewing tobacco products, the objective was to maintain uniformity in moisture and consistency. This was accomplished by incorporating in the tobacco a mixture of glycols with water, or glycols alone. And in U.S. Pat. No. 214,638 to Emery, a tobacco-treating method and resultant product was disclosed for fine-cut chewing tobacco or plug tobacco. The disclosed process for making the chewing tobacco involved dipping or spraying the tobacco with a sweetener, removing the stems from the leaves, pressing the destemmed leaves into cakes, and then cutting the cakes into fine threads, strips, or shreds. The process for making plug tobacco involved dampening or steaming the leaves, removing the stems, saturating the destemmed leaves with sweetener, drying the saturated leaves and then cutting and/or pressing the leaves into the desired shape.

Tobacco products made by the above-described processes suffer from many undesirable qualities. For example, many people do not like the "fluffiness" and large, non-uniform leaves found in loose leaf. In many present loose leaf products, there is found an unacceptable amount and degree of stems and piece sizes inadvertently left in the final product. For these reasons, many people will use another type of tobacco product such as plug tobacco, even though they do not find acceptable the hardness of the plug product. There is therefore a need for a loose leaf tobacco product with a smaller, more uniform leaf size which would appeal to both loose leaf chewers and plug users. In addition, such a desired product, unlike that of the prior art, should be easy to use and contain few, if any, objectionable stems or veins, and therefore be appealing to both loose leaf and plug users.

OBJECTS AND SUMMARY OF THE PRESENT INVENTION

It is therefore an object of the present invention to overcome the defects of the prior art, such as indicated above.

It is a further object to provide for an improved smokeless chewing tobacco made from destemmed tobacco leaves, wherein the perception of stem-like veins is diminished by cutting the tobacco leaf across the veins.

It is yet a further object to provide an improved chewing tobacco product which is appealing to both loose leaf users as well as plug users.

Another object of the present invention is to provide a loose leaf chewing tobacco product of small, uniform leaf size.

Yet another object of the present invention is to provide a tobacco product containing virtually no objectionable stem and stem-like vein parts.

These and other objects are attainable in accordance with the present invention in which cut, hand stemmed leaves are first treated to remove some of the major veins are cut across the grain of the veins to produce a specific number of cuts per inch of tobacco, and then cased with a casing liquid. The cased product is dried to a finished moisture content of 21 to 24 percent, and then packaged.

DETAILED DESCRIPTION OF THE PROCESS AND PREFERRED EMBODIMENTS OF THE PRODUCT

The chewing tobacco product of the present invention employs cut, hand stemmed leaves of one or more varieties of tobacco, from which some of the objectionable major veins are removed by threshing. These leaves are then further cut on a multi-bladed rotary cutter set to produce a specific number of cuts per inch of tobacco. In this way, a blend of tobacco with very uniform leaf size can be obtained. Additionally, the blend is remarkably free of stems and objectionable veins in comparison to currently available loose leaf blends, as will be shown later in the examples.

In manufacturing tobacco by this process, hand stemmed leaves, such as, but not limited to, Wisconsin, Pennslyvania, or Connecticut Shade Grown cigar wrapper leaf, which have been threshed to remove some of the objectionable veins, are blended in the desired proportion. This blend is fed into the above-mentioned multi-bladed rotary cutter at a constant input speed. With the appropriate number of blades and rotation speed, from 4 to 12 cuts per inch of tobacco can be made, thereby producing cut leaves of very uniform size. The spacing of the cuts is important and should not exceed $\frac{1}{4}$ inch. Because of the random nature of rotary cutting, cuts are made across the "grain" of the stem.

The blend of leaves thus cut are next cased with a blend of ingredients including, but not limited to, licorice, sugars and various syrups. The casing liquid can be applied either by spraying the liquid on the tobacco as it passes into a rotating mixing drum, or by passing the tobacco through a reservoir of the liquid casing. This is followed by squeezing of the excess casing from the cased tobacco. Thus, in contrast to previous processes, the process of the present invention provides that the tobacco is cased after cutting, rather than casing and then cutting the cased tobacco. This difference in processing produces a more uniform product due to more uniform cutting, the product having also no cut edges of tobacco without casing.

At this point, the tobacco will contain from 35 to 40 percent moisture. It is then held in this state from 4 to 24 hours in a holding silo to allow the product to equilibrate. After the holding period, the wet tobacco is passed through a dryer where the product is dried to a finished moisture of 21 to 24 percent. The product is then held in another silo to allow the moisture to equilibrate again before packaging the product in foil pouches.

By way of the following examples, the tobacco blend and the finished product are compared to representative products currently on the market.

EXAMPLE 1

In this example, the size distribution of the tobacco blend obtained by the above process is compared to the size distribution of a typical blend normally used in producing loose leaf tobacco. The size distribution is determined on a vibrating screen sizer containing screens with $\frac{1}{8}''$, $\frac{1}{4}''$, $\frac{3}{8}''$, and $\frac{7}{8}''$ square openings.

| | PERCENT RETAINED | |
|---|---|---|
| Screen Size | Commercial Blend | Present Blend |
| $\frac{7}{8}''$ | 16.2% | 0.87% |
| $\frac{3}{8}''$ | 49.0% | 15.65% |
| $\frac{1}{4}''$ | 19.2% | 43.48% |
| $\frac{1}{8}''$ | 13.0% | 33.04% |
| Fines | 2.6% | 6.96% |

As can be seen from the table, over 75% of the present blend is in a desirable size range of less than $\frac{3}{8}''$ but greater than $\frac{1}{8}''$. In addition, there is a very small amount of pieces greater than $\frac{7}{8}''$. Thus, the present blend has a more uniform size than normal commercial blends as well as being smaller in size.

EXAMPLE 2

In this example, the amount of undesirable or objectionable stems or veins in the product manufactured by this process is compared to the amount of undesirable stems or objectionable in loose leaf products currently on the market. Undesirable or objectionable veins or stems are defined as a stem or leaf vein in excess of 0.75 inches in length and/or 0.02 inches in diameter. The percentage of undesirable stems or veins in a product is determined by hand picking a weight amount of tobacco and weighing the amount of undesirable stems thus obtained. It can be seen in the following table that a loose leaf product made by this process contained only 0.054% or objectionable stems or objectionable veins compared to 0.42% to 0.96% objectionable stems or objectionable in commercially available loose leaf products.

| | Tobacco | Objectionable Stems or Veins | Objectionable Stems or Veins % |
|---|---|---|---|
| Present Product | 37.0 ozs. | 0.02 ozs. | 0.054% |
| Brand #1 | 40.2 ozs. | 0.17 ozs. | 0.42% |
| Brand #2 | 35.8 ozs. | 0.33 ozs. | 0.92% |
| Brand #3 | 34.6 ozs. | 0.33 ozs. | 0.96% |
| Brand #4 | 37.4 ozs. | 0.18 ozs. | 0.47% |

It will thus be seen from the above examples, that the loose leaf products produced by this process have physical properties which are significantly different and more desirable than currently available loose leaf products.

It is to be understood that the invention is not limited to the embodiments disclosed which are illustratively offered and that modifications may be made without departing from the invention.

What is claimed is:

1. A method for producing loose leaf chewing tobacco, comprising:

providing loose destemmed and threshed tobacco leaves from which essentially only the main stem of said tobacco leaves have been removed, said stemmed and threshed loose-leaves containing veins or stems in excess of 0.75 inches in length or 0.02 inches in diameter;

passing said loose leaves through a multi-bladed rotary cutter to produce cuts uniformly spaced from one another a maximum of about $\frac{1}{4}$ inch, to produce loose cut leaves of relatively uniform size, the cuts extending largely across the tobacco veins;

casing said loose, rotary-cut leaves with a casing mixture; and drying said loose, cased leaves to form a loose leaf tobacco product;

so as to effectively diminish the perception of veins by a user.

2. A method according to claim 1, wherein the cuts produced by said cutter are in the range of 4 to 12 cuts per inch.

3. The method of claim 1, wherein said step of casing comprises spraying said casing mixture on the tobacco.

4. The method of claim 1, wherein said step of casing comprises passing said loose cut leaves through a reservoir of said casing mixture.

5. The method of claim 4, wherein said step of casing further comprises subsequently removing excess casing mixture from said loose cut leaves.

6. The method of claim 1, wherein said step of cutting comprises producing at least 50% of pieces having a size of less than $\frac{3}{8}''$.

7. A loose leaf chewing tobacco product obtained by the method of claim 1.

8. A loose leaf chewing tobacco product obtained by the method of claim 2.

9. A loose leaf chewing tobacco product obtained by the method of claim 3.

10. A loose leaf chewing tobacco product obtained by the method of claim 4.

11. A loose leaf chewing tobacco product obtained by the method of claim 5.

12. A loose leaf chewing tobacco product obtained by the method of claim 6.

* * * * *